US007921476B2

(12) United States Patent
Chiang

(10) Patent No.: US 7,921,476 B2
(45) Date of Patent: Apr. 12, 2011

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 569 days.

(21) Appl. No.: 12/078,578

(22) Filed: Apr. 2, 2008

(65) Prior Publication Data

US 2009/0229086 A1 Sep. 17, 2009

(30) Foreign Application Priority Data

Mar. 17, 2008 (TW) ..... 97204588 U

(51) Int. Cl.
*A61F 9/02* (2006.01)

(52) U.S. Cl. ..... 2/448; 2/452; 24/68 E

(58) Field of Classification Search ..... 2/426, 445, 2/448, 452

See application file for complete search history.

(56) References Cited

U.S. PATENT DOCUMENTS 5,881,394 A * 3/1999 Garofalo ..... 2/428
6,871,386 B2 * 3/2005 Chen-Lieh ..... 24/168
7,779,488 B2 * 8/2010 Fukasawa ..... 2/428
7,823,226 B2 * 11/2010 Chou ..... 2/448

* cited by examiner

*Primary Examiner* — Katherine Moran
(74) *Attorney, Agent, or Firm* — Rosenberg, Klein & Lee

(57) ABSTRACT

Swimming goggles include a frame unit, lenses assembled on the frame unit, and a strap unit. The strap unit comprises at least a head strap with at least a free end, and a buckle for securing and adjusting the head strap. The free end defines a plurality of stop grooves therein. The buckle includes a base and a press portion movable radially relative to the base. The base has a first axis and a second axis respectively formed on opposing ends thereof for supporting the head straps. A first abut portion and a second abut portion are formed on the base. The press portion comprises a first stop portion and a second stop portion, an operating portion between the first stop portion and the second stop portion, and a first branch and a second branch respectively on opposite sides of the operating portion.

10 Claims, 8 Drawing Sheets

SWIMMING GOGGLES

BACKGROUND OF THE INVENTION

1. Field of the Invention

The present invention relates to swimming goggles, and particularly to swimming goggles with an adjustable head strap.

2. Related Art

Conventional swimming goggles typically have a head strap adjustable with a buckle. The buckle is generally shaped with a couple of loops adjoining to each other. The head strap has two free ends respectively extending through the loops and being overlapped. As the head strap is adjusted in length, friction produced by the overlapped parts of the head strap confines movement, making adjustment cumbersome.

Another fashion of conventional buckles are respectively disposed on left sides and right sides of the lenses frame. Each conventional buckle forms a biasing arm, which biases against denticulate grooves of the head strap, thus the head strap is allowed to be adjusted in a single direction only (namely shortening length of the head strap). To loosen the head strap, the biasing arm is disengaged from the denticulate grooves. However, the conventional buckles are strictly required in manufacture, and therefore lead to high cost. So, it is desired to make buckles of swimming goggles be easily used and manufactured.

SUMMARY OF THE INVENTION

Accordingly, an object of the present invention is to provide swimming goggles which can adjust at least a head strap easily and conveniently.

The swimming goggles comprise a frame unit, lenses assembled on the frame unit, and a strap unit. The strap unit comprises at least a head strap with a plurality of stop grooves therein, and a buckle for securing and adjusting the head strap. The buckle includes a base and a press portion. The base has a first axis and a second axis respectively formed on opposing ends thereof for supporting the head strap. A first abut portion and a second abut portion are formed on the base, and are respectively spaced appropriately from the first axis and the second axis. The press portion is pivoted between the first abut portion and the second abut portion, and is movable radially relative to the base. The press portion comprises a first stop portion and a second stop portion respectively adjacent the first axis and the second axis, an operating portion between the first stop portion and the second stop portion, and a first branch and a second branch respectively on opposite sides of the operating portion. The first branch and the second branch respectively abut against the first abut portion and the second abut portion. When the operating portion is pressed downwardly, the first branch and the second branch respectively abut against the first abut portion and the second abut portion, operating with double fulcrums, forcing the first stop portion and the second stop portion to move upwardly. The head strap is adjustable in length by controlling abutment against the stop grooves.

DESCRIPTION OF THE PREFERRED EMBODIMENTS

Figure 1:
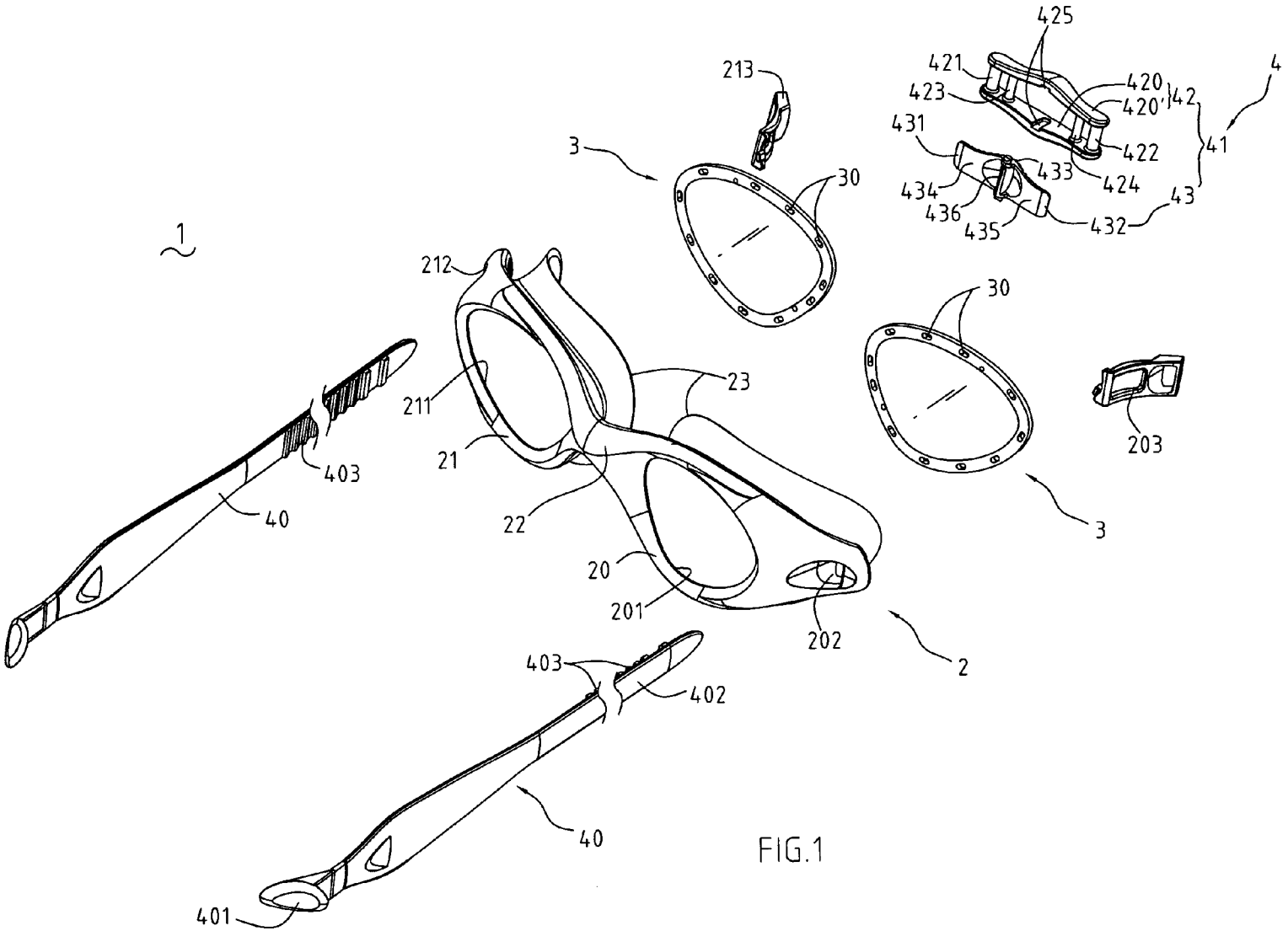
FIG. 1 is an exploded view of swimming goggles of the present invention.
Figure 6:
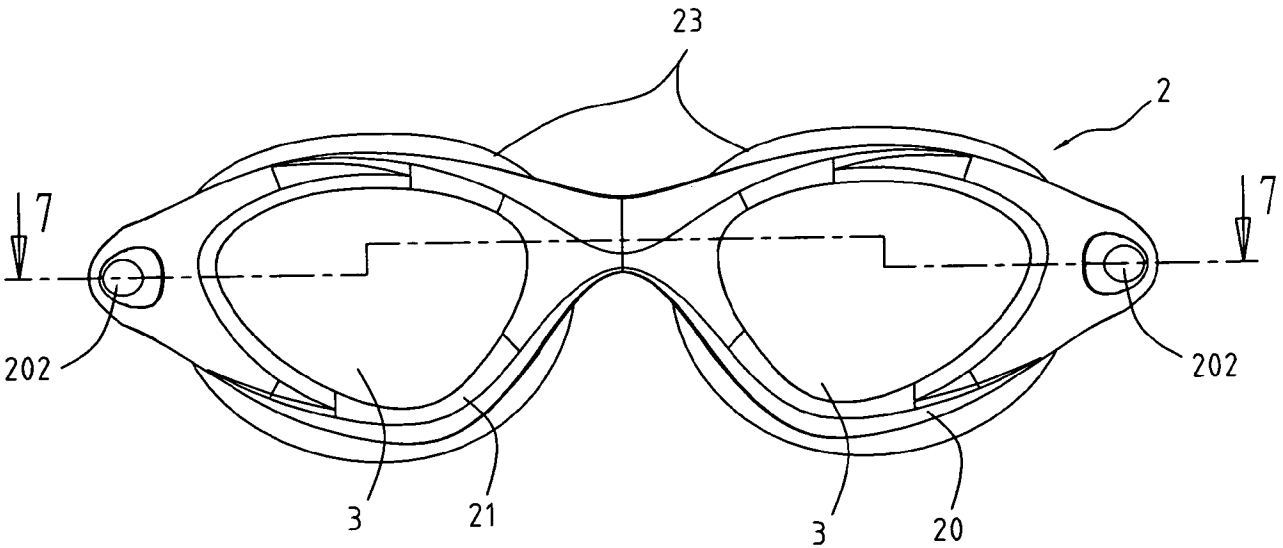
FIG. 6 is an elevation view of FIG. 5.
Figure 7:
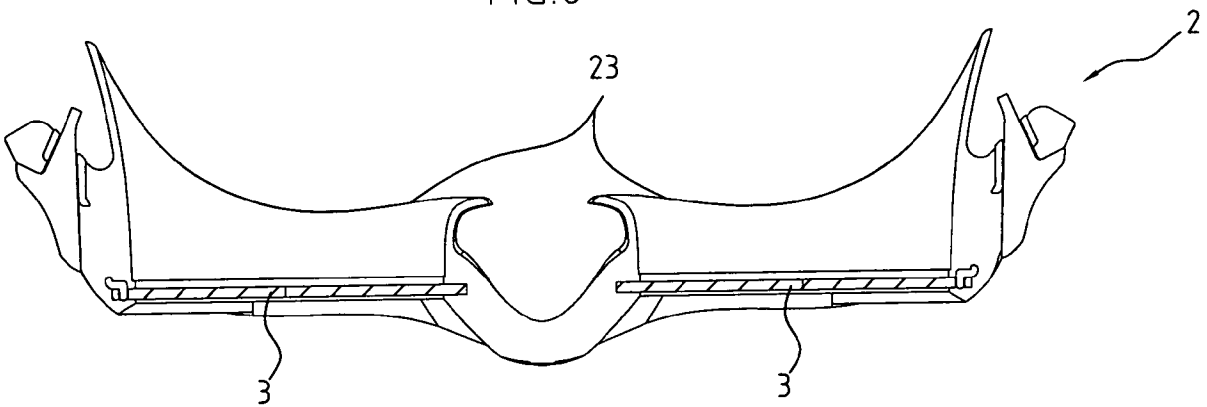
FIG. 7 is a sectional view taken along the line 7-7 in FIG. 6.

With reference to FIG. 1, swimming goggles 1 in accordance with the present invention comprise a frame unit 2, lenses 3 assembled on the frame unit 2, and a strap unit 4. Further referring to FIGS. 6-7, the frame unit 2 includes a left frame 20, a right frame 21, a nose bridge 22 and pads 23 which are integrally shaped by soft material, for example, Thermal Plastic Rubber (TPR), Silica gel or the like. A first slot 201 is defined in the left frame 20 and a second slot 211 is defined in the right frame 21 respectively for receiving the lenses 3. The lenses 3 defines injecting holes 30 in peripherals thereof for being integrated with the left frame 20 and the right frame 21 when the frame unit 2 is shaped. Assembling holes 202, 212 are respectively defined on outer rims of the left frame 20 and the right frame 21 for assembling the strap unit 4. Rigid assembling frames 203, 213 are respectively implanted into the assembling holes 202, 212 before shaping, reinforcing strength of the assembling holes 202, 212, thereby resisting drawing force of head straps when the goggles are worn. In one embodiment, the assembling frames 203, 213 are made by hard material, such as PP.

Please see FIGS. 2A-2C and 3A-3B, the strap unit 4 comprises at least a head strap 40, a buckle 41 and at least a clip element 5. According to one embodiment, the strap unit 4 comprises two head straps 40. Each head strap 40 has a link end 401 at one end and a free end 402 at the other end. The link end 401 connects with the frame unit 2, and may form appropriate profile to match with the assembling holes 202/212 of the frame unit 2. The free end 402 wraps on the buckle 41, and defines a plurality of stop grooves 403 thereon. Each clip element 5 defines a first positioning hole 50 and a second positioning hole 51 for positioning and securing the free end 402 of the head strap 40.

The buckle 41 comprises a base 42 and a press portion 43 assembled together. The base 42 includes a first plate 420 and a second plate 420' opposing to each other. A first axis 421 and a second axis 422 are respectively formed on opposing ends of the base 42 for supporting the head straps 40. In one embodiment, the first axis 421 and the second axis 422 are unitarily fixed on and span the opposing ends of the first plate 420 and the second plate 420'. A first abut portion 423 and a second abut portion 424 are formed on the base 42, and are respectively spaced appropriately from the first axis 421 and the second axis. In one embodiment, the first abut portion 423 and the second abut portion 424 are posts unitarily straddling between the first plate 420 and the second plate 420'. Guiding grooves 425 are respectively formed on the first plate 420 and the second plate 420' and correspond to each other.

Figure 2A:
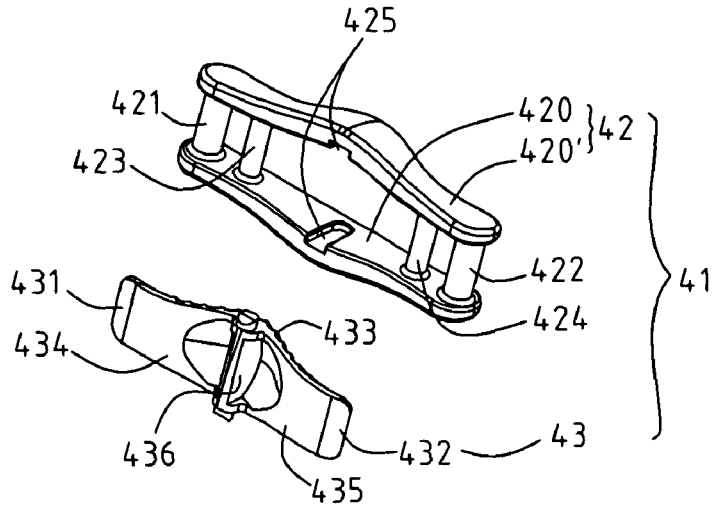
FIGS. 2A, 2B and 2C respectively show assembled stages of the swimming goggles of FIG. 1.
Figure 2B:
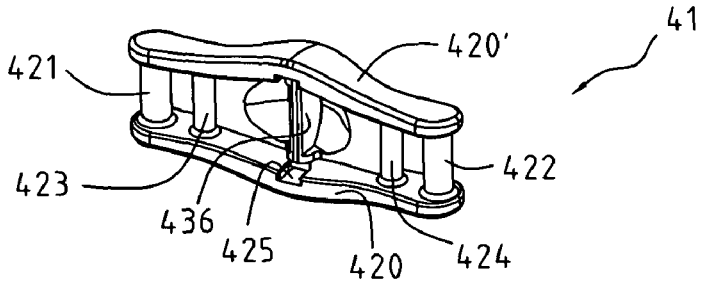
Figure 2C:
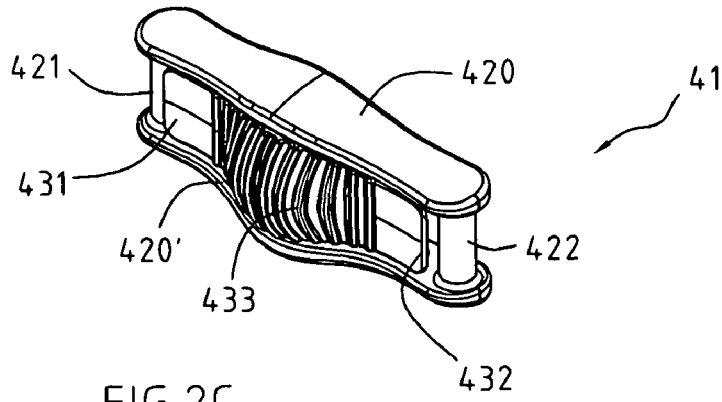
Figure 3A:
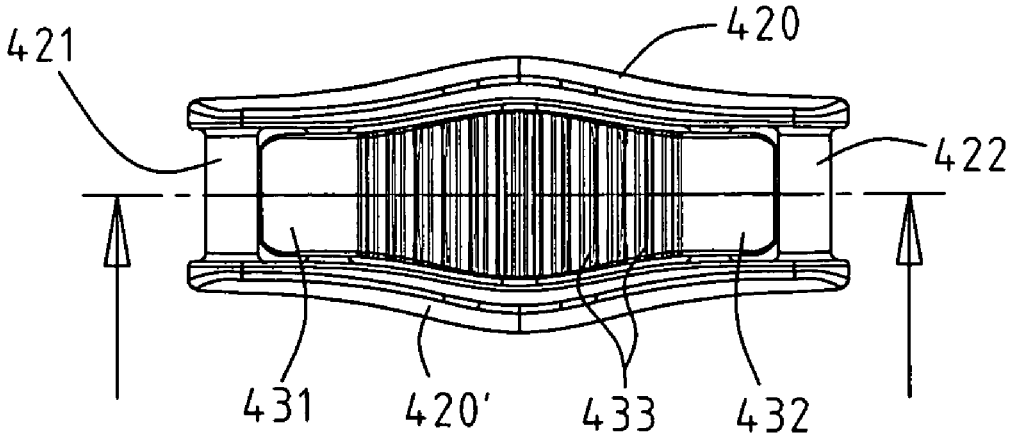
FIG. 3A is an elevation view of FIG. 2C.
Figure 3B:
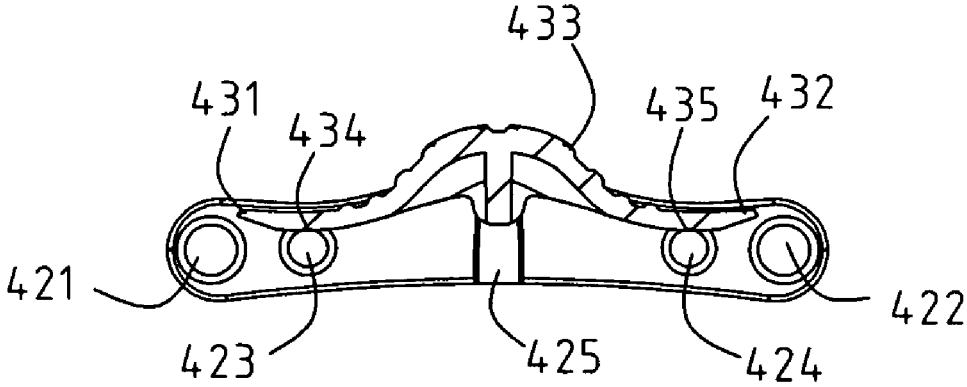
FIG. 3B is a sectional view taken along the line 3B-3B in FIG. 3A.

Referring to FIGS. 2A, 2B and 2C, the press portion 43 is flat and elongated, and is pivoted between the first abut portion 423 and the second abut portion 424. The press portion 43 comprises a first stop portion 431 and a second stop portion 432 respectively on opposite ends thereof and adjacent the first axis 421 and the second axis 422, an operating portion 433 on a top thereof, and a first branch 434 and a second branch 435 on a bottom thereof and respectively on opposite sides of the operating portion 433. The first branch 434 and the second branch 435 respectively press against the first abut portion 423 and the second abut portion 424. A pivot shaft 436 is formed opposite the operating portion 433 for assembling to the guiding grooves 425. Thus, the operating portion 433 is able to displace radially relative to the base 42. The operating portion 433 forms a coarse surface to enhance friction. A central portion of the operating portion 433 is substantially higher than the first stop portion 431 and the second stop portion 432 such that the operating portion 433 possesses a certain flexibility to return when is forced to be deformed.

Figure 4A:
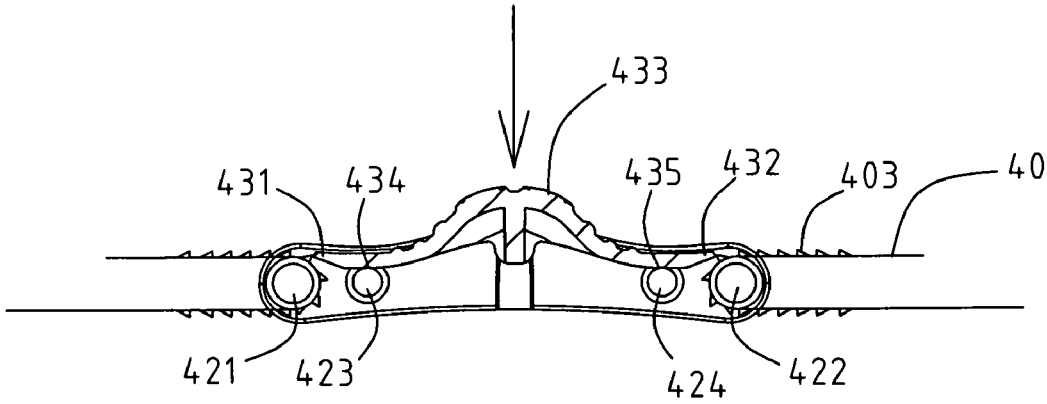
FIGS. 4A and 4B respectively illustrate the swimming goggles before or after adjustment of head strap.
Figure 4B:
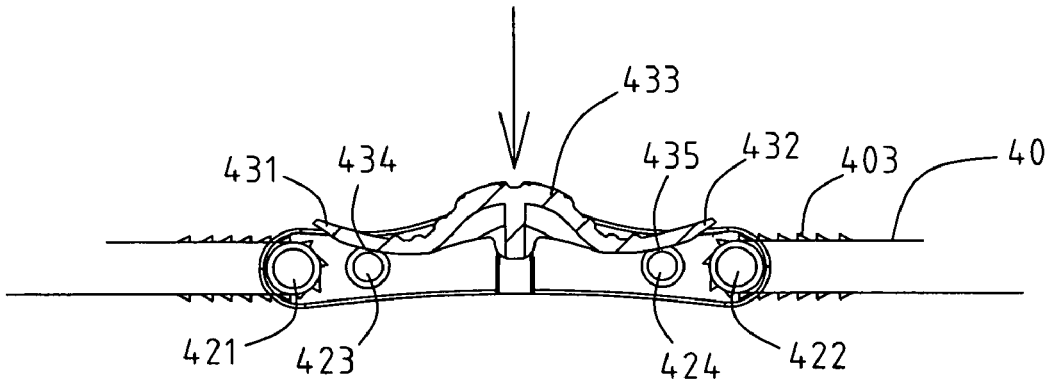
Figure 5:
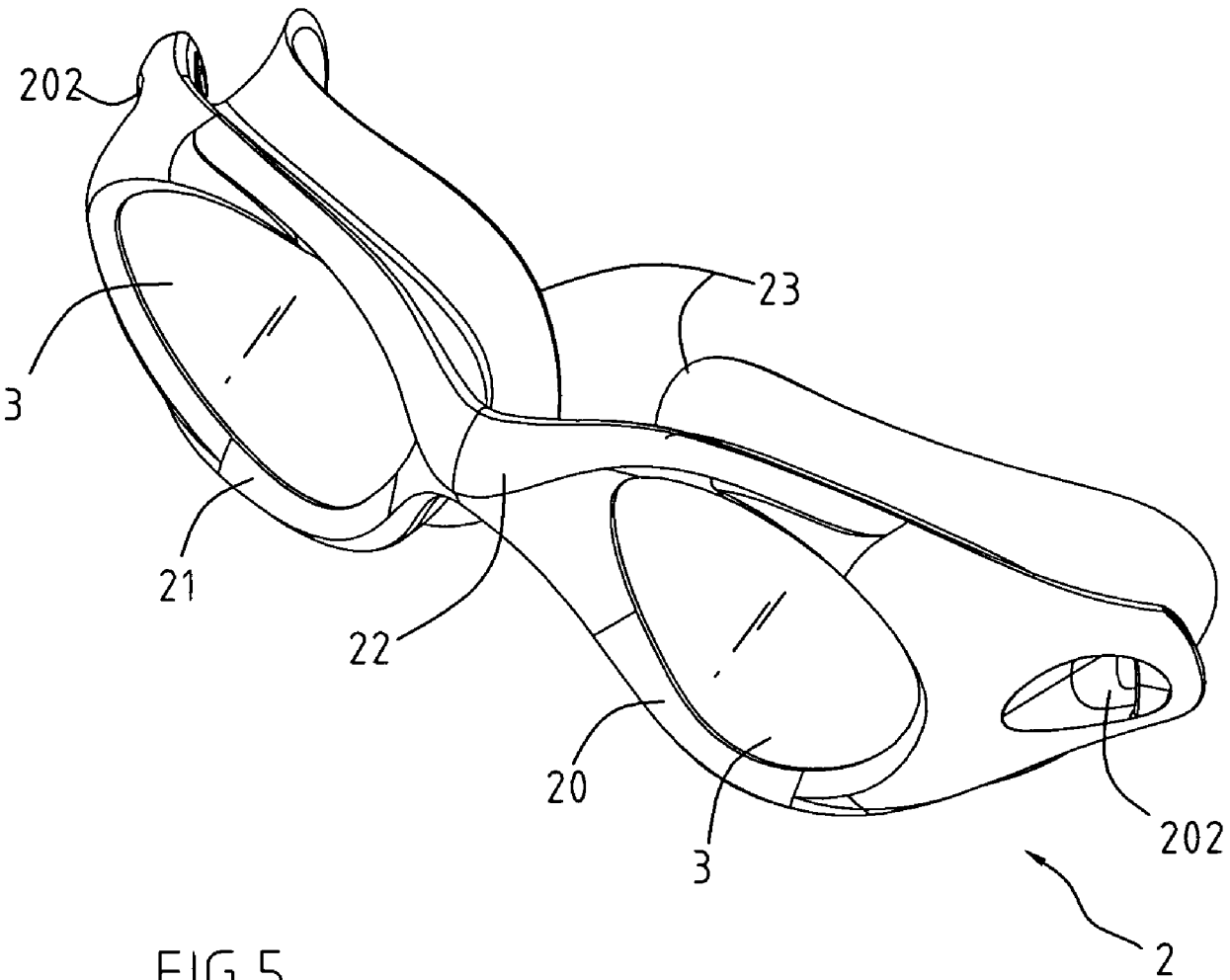
FIG. 5 is an assembled view of FIG. 1.

Further referring to FIGS. 4A and 4B, the first stop portion 431 and the second stop portion 432 are respectively abut the stop grooves 403 of the head straps 40. When the operating portion 433 is pressed downwardly, as the arrow in FIG. 4A, the first branch 434 and the second branch 435 respectively abut against the first abut portion 423 and the second abut portion 424, operating with a couple of fulcrums, forcing the first stop portion 431 and the second stop portion 432 to move upwardly. As shown in FIG. 4B, when the force exerted to the operating portion 433 is removed, the operating portion 433 will return to the original state by virtue of its flexibility. Therefore, the head straps 40 are adjustable in length by controlling abutment of the first stop portion 431 and the second stop portion 432 against the stop grooves 403 of the head straps 40.

Figure 8:
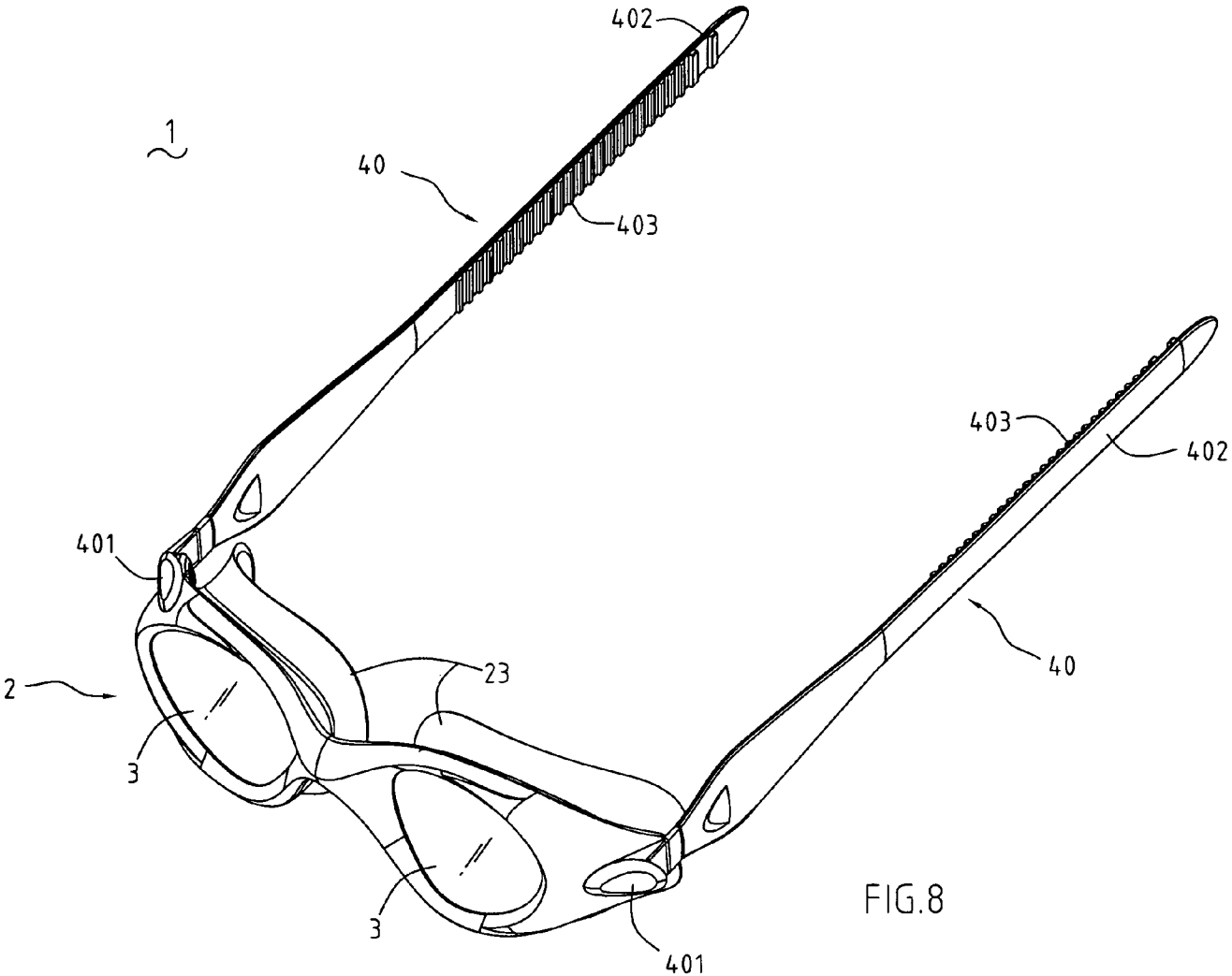
FIGS. 8 and 9 respectively illustrate a strap unit of the swimming goggles being assembled onto a frame unit and buckles step by step.
Figure 9:
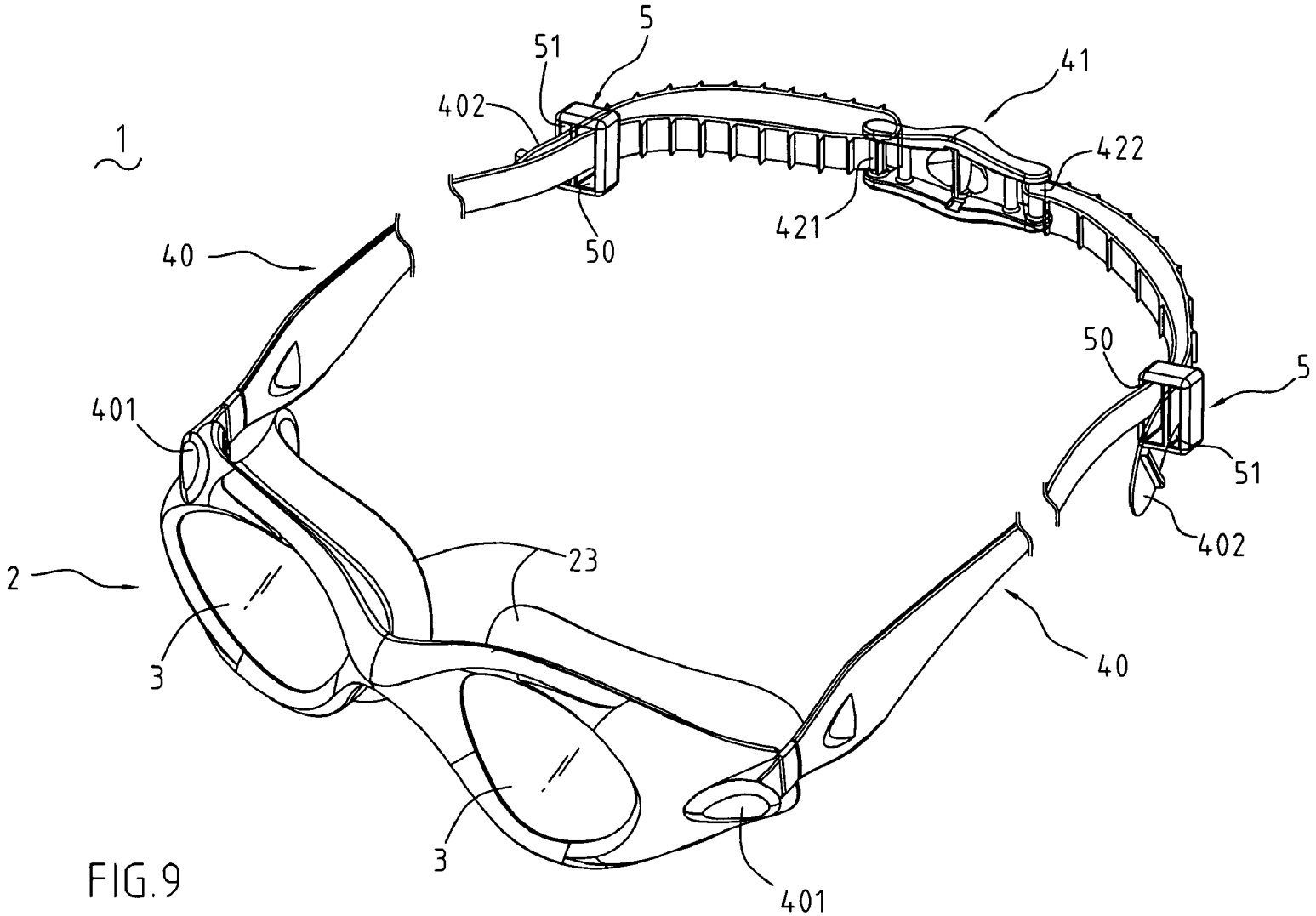

Referring to FIGS. 1, 8 and 9, the free ends 402 of the head straps 40 respectively extend through the assembling holes 202, 212. The link ends 401 are respectively assembled on the assembling holes 202, 212, as shown in FIG. 8. The free ends 402 respectively extend through the first positioning holes 50 of the clip elements 5, encircle the first axis 421 and the second axis 422, and then pass through the second positioning holes 51 of the clip element 5. Owing to leverage operation with double fulcrums, the first stop portion 431 and the second stop portion 432 of the operating portion 433 control abutment against the stop grooves 403 of the head straps 40 when the operating portion 433 is pressed.

The present examples and embodiments are to be considered in all respects as illustrative and not restrictive, and the invention is not to be limited to the details given herein. Numerous modifications, changes, variations, substitutions and equivalents will occur to those skilled in the art without departing from the spirit and scope of the present invention as defined by the appended claims.

What is claimed is:

1. Swimming goggles comprising a frame unit, lenses assembled on the frame unit, and a strap unit, said strap unit comprising at least a head strap with a plurality of stop grooves therein, and a buckle for securing and adjusting the head strap, the buckle including:

a base having a first axis and a second axis respectively formed on opposing ends thereof for supporting the head strap, a first abut portion and a second abut portion being formed on the base and being respectively spaced appropriately from the first axis and the second axis; and a press portion pivoted between the first abut portion and the second abut portion and movable radially relative to the base, and the press portion comprising a first stop portion and a second stop portion respectively adjacent the first axis and the second axis, an operating portion between the first stop portion and the second stop portion, and a first branch and a second branch respectively on opposite sides of the operating portion, the first branch and the second branch respectively abutting against the first abut portion and the second abut portion;

wherein when the operating portion is pressed downwardly, the first branch and the second branch respectively abut against the first abut portion and the second abut portion, operating with double fulcrums, forcing the first stop portion and the second stop portion to move upwardly, such that the head strap is adjustable in length by controlling abutment against the stop grooves.

2. The swimming goggles as claimed in claim 1, wherein the base includes a first plate and a second plate opposing to each other, and wherein the first axis and the second axis are unitarily fixed on and span opposing ends of the first plate and the second plate.

3. The swimming goggles as claimed in claim 2, wherein the first abut portion and the second abut portion are posts unitarily straddling between the first plate and the second plate.

4. The swimming goggles as claimed in claim 3, wherein guiding grooves are respectively formed on the first plate and the second plate and between the first abut portion and the second abut portion, and correspond to each other.

5. The swimming goggles as claimed in claim 4, wherein a pivot shaft is formed opposite the operating portion for assembling to the guiding grooves, whereby the press portion is able to displace radially relative to the base.

6. The swimming goggles as claimed in claim 5, wherein the press portion is flat and elongated, and wherein the first stop portion and the second stop portion are respectively located on opposite ends thereof, the operating portion is located on a top thereof, and the first branch and the second branch are located on a bottom thereof.

7. The swimming goggles as claimed in claim 6, wherein the operating portion forms a coarse surface to enhance friction, and has a central portion substantially higher than both sides thereof.

8. The swimming goggles as claimed in claim 1, wherein the strap unit further comprises at least a clip element, each clip element defining a first positioning hole and a second positioning hole for positioning and securing the free end of the head strap.

9. The swimming goggles as claimed in claim 1, wherein the strap unit comprises two head straps respectively wrapping the first axis and the second axis of the base.

10. The swimming goggles as claimed in claim 9, wherein each head strap has a link end connecting with the frame unit, and a free end wrapping on the buckle and defining the stop grooves therein.

* * * * *